US006412261B1

(12) United States Patent
Welshans

(10) Patent No.: US 6,412,261 B1
(45) Date of Patent: Jul. 2, 2002

(54) METHOD OF REINFORCING A FIBER WITH SPIDER SILK

(75) Inventor: Wendy L. Welshans, Litchfield, CT (US)

(73) Assignee: The Forman School, Litchfield, CT (US)

( * ) Notice: Subject to any disclaimer, the term of this patent is extended or adjusted under 35 U.S.C. 154(b) by 0 days.

(21) Appl. No.: 09/681,340

(22) Filed: Mar. 21, 2001

(51) Int. Cl.[7] ..... D02G 03/02
(52) U.S. Cl. ..... 57/3
(58) Field of Search ..... 57/3, 11, 12, 13, 57/210, 224, 225, 226, 227, 228

(56) References Cited

U.S. PATENT DOCUMENTS

| | | | | | |
|---|---|---|---|---|---|
| 1,874,502 | A | * | 8/1932 | Green | 57/12 |
| 2,056,611 | A | | 10/1936 | Loewe | 19/3 |
| 3,791,388 | A | * | 2/1974 | Hunter et al. | 128/335.5 |
| 4,434,200 | A | | 2/1984 | Fash et a l. | 428/257 |
| 4,509,320 | A | * | 4/1985 | Maeda | 57/225 |
| 4,887,422 | A | | 12/1989 | Klees et al. | 57/220 |
| 5,245,012 | A | | 9/1993 | Lombari et al. | 530/353 |
| 5,456,974 | A | * | 10/1995 | Lundblad et al. | 428/229 |
| 5,927,059 | A | * | 7/1999 | Goertz | 57/3 |
| 5,979,288 | A | | 11/1999 | Gallagher et al. | 87/36 |
| 5,989,894 | A | | 11/1999 | Lewis et al. | 435/252.3 |
| 6,035,621 | A | | 3/2000 | Scheerer et al. | 57/224 |
| 6,140,261 | A | | 10/2000 | Uhimann | 442/306 |

FOREIGN PATENT DOCUMENTS

JP 401068533 * 3/1989

OTHER PUBLICATIONS

Unraveling the Weave of Spider Silk by Ricki Lewis, Ph.D., Lewis/ Life–On–line Resources Articles, pp. 1–5.
Doctor Spin, by Mike Toner, Discover, pp. 32–36 & 55–56.
First Find Your Spider, Astronomy, pp. 28 and 30.

* cited by examiner

*Primary Examiner*—Danny Worrell
*Assistant Examiner*—Shaun R Hurley
(74) *Attorney, Agent, or Firm*—Howard & Howard

(57) ABSTRACT

The subject invention is a method of reinforcing a fiber (10) utilizing *Nephila clavipes* spider silk (20). The method comprises the steps of suspending the fiber (10) between the first support (12) and the second support (14) wherein the suspended fiber (10) defines a central axis (18) and positioning a silk line dispensing device (16) near the fiber aligned with the central axis (18) for attaching a silk line (20) to the fiber (10). A *N. clavipes* spider (17) is positioned directly onto the fiber (10), and, once the *N. clavipes* spider (17) is agitated, it excretes large sticky discs or attachment discs from its pyriform gland to attach its silk line (20) to the fiber (10). The method is characterized by rotating the fiber (10) about the central axis (18) to helically coat the fiber (10) with the silk line (20) for increasing the strength of the fiber (10). The fiber (10) is wound around a spool (30) and directly incorporated into a fabric (40).

8 Claims, 3 Drawing Sheets

METHOD OF REINFORCING A FIBER WITH SPIDER SILK

BACKGROUND OF INVENTION

1. Field of the Invention

A method of reinforcing a fiber with a helically wrapped reinforcement material utilizing a reinforcement material dispensing unit.

2. Description of the Prior Art

Various methods of reinforcing a fiber are known to one skilled in the art. These methods include suspending a fiber between a first support and a second support and positioning a dispensing device in close proximity to the fiber. The dispensing device then dispenses a reinforcing material, attaches the reinforcing material to the fiber, and rotates the dispensing device in a circular path around the fiber. The dispensing device helically wraps the reinforcing material about the fiber for increasing the strength of the fiber.

One such method is disclosed in U.S. Pat. No. 5,979,288 to Gallagher et al. The '288 patent discloses a helical braider for constructing a triaxially braided tubular member. A winding station dispenses a fiber and a winder rotator causes the winding station to rotate about the member.

Additionally, other methods disclose obtaining different materials and utilizing the materials for reinforcing the fiber. One material that is increasingly being studied is silk from a *Nephila clavipes* spider. The spider silk is forcibly extracted from the *N. clavipes* spider and used for purification to study the proteins of the silk. The proteins are then recombined in an attempt to mimic the properties of the silk as dispensed by the *N. clavipes* spider. One such method is shown in U. S. Pat. No. 5,989,894 to Lewis et al. The '894 Patent discloses a method for obtaining silk from the *N. clavipes* spider. A single silk fiber is extracted from one spinneret of the *N. clavipes* spider and attached to a spool. The spool is connected to an electric drill and the silk is forcibly extracted from the spider.

However, these methods do not use the spider silk to directly reinforce the fiber and the recombined proteins do not have identical properties as those of the *N. clavipes* spider silk. It would be advantageous to provide a method which increases the strength of the fiber by rotating the fiber and helically coating the fiber with silk.

SUMMARY OF INVENTION

The subject invention is a method of reinforcing a fiber suspended between a first support and a second support utilizing a silk line dispensing device. The method comprises the steps of suspending a fiber between the first support and the second support wherein the suspended fiber defines a central axis and positioning the silk line dispensing device near the fiber and aligned with the central axis for attaching a silk line to the fiber. The silk line is then attached to the fiber. The method is characterized by rotating the fiber about the central axis to helically coat the fiber with the silk line for increasing the strength of the fiber.

One advantage of the subject invention includes directly incorporating the *N. clavipes* spider silk to the fiber for increasing the properties of the fiber. Another advantage is the harvestability of the *N. clavipes* spiders in the regions which they are commonly found. The *N. clavipes* spiders are found in the southeast regions of the United States through Argentina and Peru. The *N. clavipes* spider is most commonly found in Puerto Rico. Farmers in these regions are continually cutting down the rain forests for their livestock.

However, these farmers could shift their resources from clearing the forests to harvesting the *N. clavipes* spiders due to the profitability of harvesting the *N. clavipes* spider silk as a valuable resource when used to reinforce a fiber.

BRIEF DESCRIPTION OF DRAWINGS

Other advantages of the present invention will be readily appreciated as the same becomes better understood by reference to the following detailed description when considered in connection with the accompanying drawings wherein.

DETAILED DESCRIPTION

Figure 1:
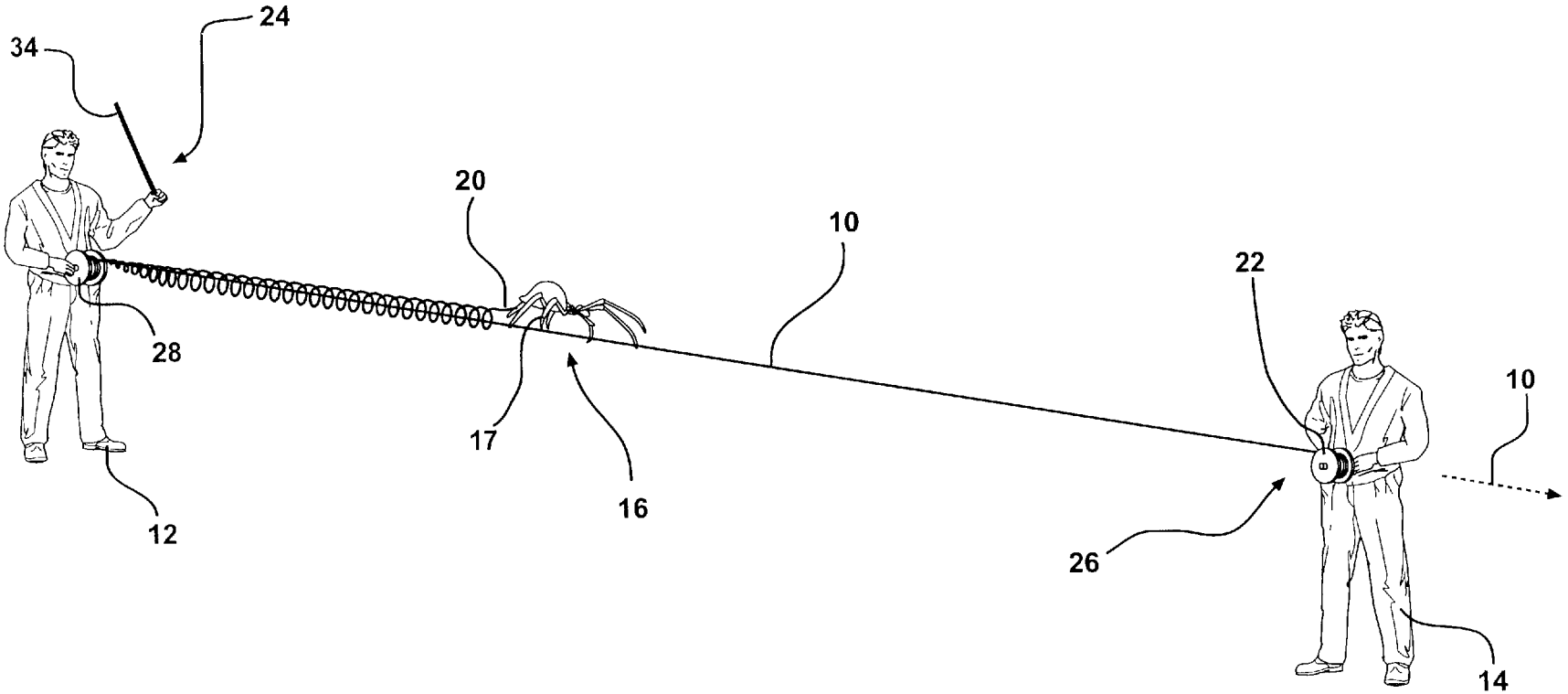
FIG. 1 is a schematic view of a silk line dispensing device helically coating a fiber with silk.

Referring to the Figures, wherein like numerals indicate like or corresponding parts throughout the several views, a method of reinforcing a fiber 10 suspended between a first support 12 and a second support 14 utilizing a silk line dispensing device 16 is illustrated in FIG. 1.

Figure 2:
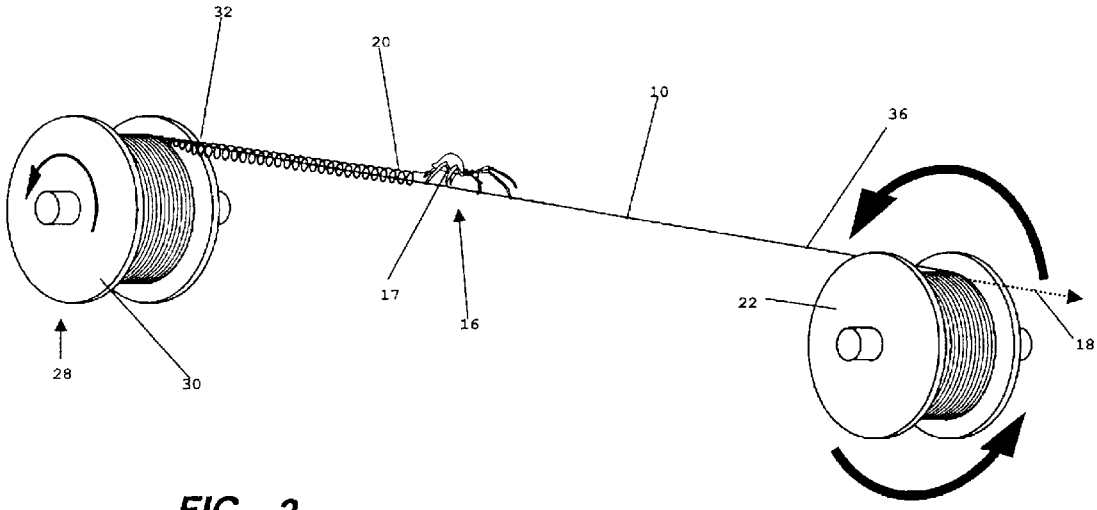
FIG. 2 is a schematic view of a spool for winding the fiber and a skein of fiber being helically coated.

The method comprises the steps of suspending the fiber 10 between the first support 12 and the second support 14 wherein the suspended fiber 10 defines a central axis 18 and positioning the silk line dispensing device 16 near the fiber aligned with the central axis 18 for attaching a silk line 20 to the fiber 10. In the preferred embodiment, the fiber 10 is suspended between a first person and a second person, as shown in FIG. 1. However, alternate supports would be obvious to one skilled in the art of spider silk collection. In FIG. 2, the fiber 10 is typically supplied in the form of a skein 22 of fiber 10. The second person therefore holds the skein 22 of fiber 10. Preferably, the fiber 10 comprises a yarn having a plurality of threads.

The silk line dispensing device 16 is preferably a *Nephila clavipes* spider and is positioned directly onto the fiber 10. However, it is foreseeable that any member of the Kingdom Animalia that is able to produce a silk like thread could accomplish the subject invention. More specifically, the silk line dispensing device preferably belongs to the *Phylum arthropoda* and Class Arachnida. Members of the Class Arachnida includes over 60,000 described species. Spiders make up the majority of the described species with around 35,000 species, while mites and ticks are the next largest species with around 25,000 species. The Arachnida also includes a diverse array of smaller groups, including scorpions (1200 species), whip spiders (70 species), whip scorpions (100 species), palpigrades (60 species), pseudoscorpions (2000 species), solpugids (900 species), and harvestmen (5000 species).

In FIG. 1, the fiber 10 is shown as including a first end 24 and a second end 26. The first end 24 of the fiber 10 is attached to a spool (30) and a winding mechanism 28 for winding the fiber 10 about the spool 30, as shown in FIG. 2. In the preferred embodiment, the winding mechanism 28 is the first person supporting the fiber 10. In alternate embodiments, motorized winding devices are utilized as is known in the art of spider silk collection. Next, the *N. clavipes* spider 17 is positioned at a first point 32 near the first support 12. In order for the *N. clavipes* spider 17 to attach its silk line 20 to the fiber 10, the *N. clavipes* spider 17 must be agitated. One way to agitate the *N. clavipes* spider 17 is to prod it with a rod 34, as shown in FIG. 1, or similar device as in known in the art of spider agitation.

Once the *N. clavipes* spider 17 is agitated, it excretes large sticky discs or attachment discs from its pyriform gland. The *N. clavipes* spider 17 uses the attachment disc as an anchor for its silk line 20. All spiders excrete the attachment disc when they are unsure of their environment. Now, the silk line 20 is attached to the fiber 10. At the same time, the winding mechanism 28 is operated and the fiber 10 begins to be wound around the spool 30. The winding of the fiber 10 causes the *N. clavipes* spider 17 to move along the fiber 10 to a second point 36, as shown in FIG. 2. As the *N. clavipes* spider 17 moves, it continuously deposits its silk line 20 along the entire length of the fiber 10.

The method is characterized by rotating the fiber 10 about the central axis 18 to helically coat the fiber 10 with the silk line 20 for increasing the strength of the fiber 10. In the preferred embodiment, the rotation of the fiber 10 about the central axis 18 is accomplished by the second person rotating the skein 22 of fiber 10. Alternately, a rotation device including a motor for rotating the skein 22 of fiber 10 as in known in the art of fiber coating. As the *N. clavipes* spider 17 travels the entire length of the fiber 10, the rotation of the fiber 10 about the central axis 18 ensures that the fiber 10 is completely coated with the silk line 20. As the fiber 10 is rotated, the *N. clavipes* Spider 17 does not rotate with the fiber 10, but remains on the top of the fiber 10.

The method may be repeated numerous times until the fiber has a sufficient coating of silk. A single *N. clavipes* spider is used for a predetermined time until the quality of their silk line 20 diminishes. In the preferred embodiment, the single *N. clavipes* spider is used to coat the entire skein 22 of fiber 10 in about one half to one hours time. The *N. clavipes* spider 17 is then returned to its cage where it is allowed to renourish for future use. The *N. clavipes* spider 17 is fed insects to replace strength and energy. Additional *N. clavipes* spiders will be utilized to apply multiple strands of silk to the fiber 10 for additional increased strength.

Figure 3:
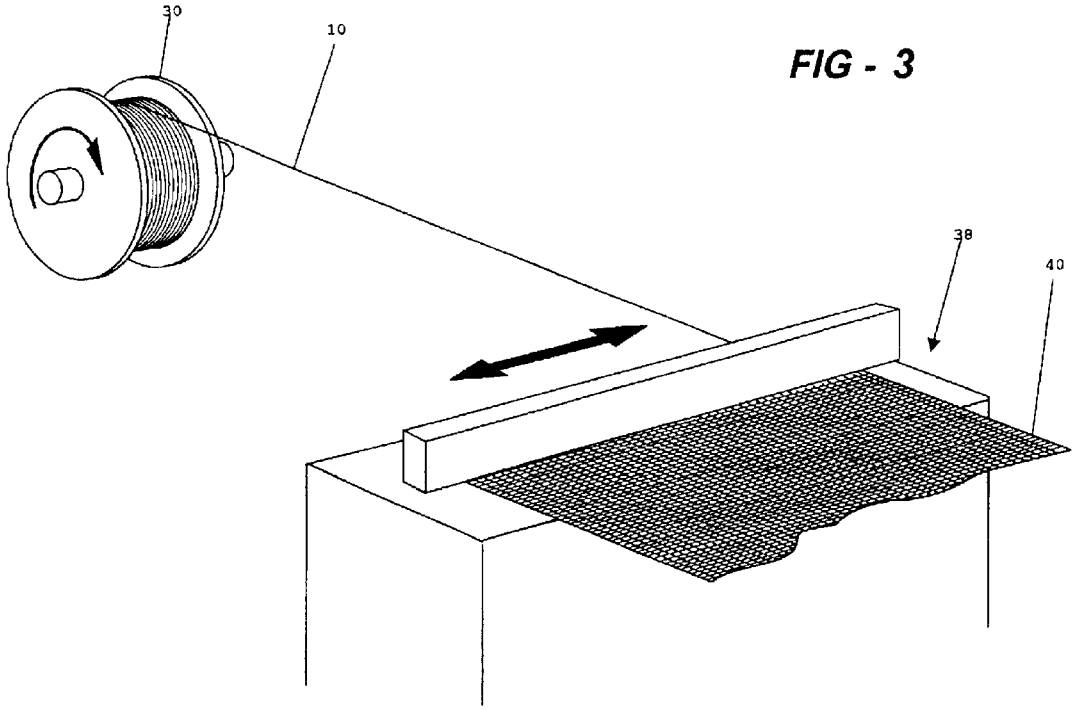
FIG. 3 is a schematic view of the spool of coated fiber being utilized in the manufacture of a fabric for a garment.

Once the fiber 10 has been sufficiently coated, the spool 30 of coated fiber 10 is knitted into a cross weave pattern 38, as shown in FIG. 3. The cross weave pattern 38 increases the strength of the fibers 10 which results in a complete fabric 40 which is to be utilized in manufacturing a garment.

Obviously, many modifications and variations of the present invention are possible in light of the above teachings. The invention may be practiced otherwise than as specifically described within the scope of the appended claims, wherein that which is prior art is antecedent to the novelty set forth in the characterized by clause. The novelty is meant to be particularly and distinctly recited in the characterized by clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A method of reinforcing a fiber suspended between a first support and a second support utilizing a silk line dispensing device, said method comprising the steps of:

suspending the fiber (10) between the first support (12) and the second support (14) wherein the suspended fiber (10) defines a central axis (18);

positioning the silk line dispensing device (16) near the fiber (10) aligned with the central axis (18) for attaching a silk line (20) to the fiber (10);

attaching the silk line (20) to the fiber (10);

rotating the fiber (10) about the central axis (18) to helically coat the fiber (10) with the silk line (20) for increasing the strength of the fiber (10);

wherein the silk line dispensing device is further defined as a member of the *Phylum arthropoda* and wherein the step of positioning the silk line dispensing device (16) is further defined by positioning the member of the *Phylum arthropoda* in close proximity to the fiber (10) for attaching the silk line (20) to the fiber (10).

2. A method as set forth in claim 1 wherein the member of the *Phylum arthropoda* is further defined as a member of the Class Arachnida and wherein the step of positioning the member of the *Phylum arthropoda* is further defined by positioning the member of the Class Arachnida on the fiber (10) for attaching the silk line (20) to the fiber (10).

3. A method as set forth in claim 2 wherein the member of the class Arachnida is further defined as a spider of the Genus Nephila and wherein the step of positioning the member of the Class Arachnida is further defined by positioning the spider of the Genus Nephila on the fiber (10) for attaching the silk line (20) to the fiber (10).

4. A method as set forth in claim 3 wherein the spider of the Genus Nephila is further defined as a *Nephila clavipes* (*N. clavipes*) spider and wherein the step of positioning the spider of the Genus Nephila is further defined by positioning the *N. clavipes* spider (17) on the fiber (10) for attaching the silk line (20) to the fiber (10).

5. A method as set forth in claim 4 wherein the step of positioning the *N. clavipes* spider (17) is further defined by moving the fiber (10) relative to the *N. clavipes* spider (17) for coating the fiber (10) from a first point (32) to a second point (36) spaced from the first point (32).

6. A method as set forth in claim 4 further defined by agitating the *N. clavipes* spider (17) to release the silk line (20).

7. A method as set forth in claim 6 further defined by connecting either one of the first point (32) and the second point (36) of the fiber (10) to a spool (30) and winding the fiber (10) such that the *N. clavipes* spider (17) moves from either one of the first point (32) and the second point (36) towards the other.

8. A method as set forth in claim 7 further characterized by knitting the fiber (10) into a cross weave pattern (38) which results in a completed fabric (40) for increasing the strength of the fiber (10) and manufacturing a garment utilizing the reinforced fabric (10).

* * * * *